US011148140B2

(12) United States Patent
Fraden

(10) Patent No.: US 11,148,140 B2
(45) Date of Patent: Oct. 19, 2021

(54) DEVICES FOR SIMULTANEOUS GENERATION AND STORAGE OF ISOLATED DROPLETS, AND METHODS OF MAKING AND USING THE SAME

(71) Applicant: BRANDEIS UNIVERSITY, Waltham, MA (US)

(72) Inventor: Seth Fraden, Newton, MA (US)

(73) Assignee: BRANDEIS UNIVERSITY, Waltham, MA (US)

( * ) Notice: Subject to any disclaimer, the term of this patent is extended or adjusted under 35 U.S.C. 154(b) by 192 days.

(21) Appl. No.: 16/477,749

(22) PCT Filed: Jan. 16, 2018

(86) PCT No.: PCT/US2018/013877
§ 371 (c)(1),
(2) Date: Jul. 12, 2019

(87) PCT Pub. No.: WO2018/132831
PCT Pub. Date: Jul. 19, 2018

(65) Prior Publication Data

US 2020/0238278 A1 Jul. 30, 2020

Related U.S. Application Data

(60) Provisional application No. 62/445,943, filed on Jan. 13, 2017.

(51) Int. Cl.
*B01L 3/00* (2006.01)
*B01L 3/02* (2006.01)

(52) U.S. Cl.
CPC ..... *B01L 3/50273* (2013.01); *B01L 3/0265* (2013.01); *B01L 2400/0406* (2013.01); *B01L 2400/0487* (2013.01); *B01L 2400/06* (2013.01)

(58) Field of Classification Search
CPC ..... B01L 3/50273; B01L 3/0265; B01L 2400/0406; B01L 2400/0487; B01L 2400/06
See application file for complete search history.

(56) References Cited

U.S. PATENT DOCUMENTS 6,637,463 B1 * 10/2003 Lei ..... B01F 5/0403 137/803
8,592,221 B2 11/2013 Fraden
(Continued)

FOREIGN PATENT DOCUMENTS

WO WO-2008130623 A1 * 10/2008 ..... G01N 1/28
WO 2016029200 A1 2/2016

OTHER PUBLICATIONS

International Searching Authority, International Search Report and Written Opinion for application PCT/US2018/013877, dated Jul. 6, 2018, 18 pages.
(Continued)

*Primary Examiner* — Jennifer Wecker
*Assistant Examiner* — Kathryn Elizabeth Limbaugh
(74) *Attorney, Agent, or Firm* — Quarles & Brady LLP

(57) ABSTRACT

A microfluidic device comprising at least one isolation unit and at least one capillary valve. The at least one isolation unit has at least one chamber. The at least one chamber configured to receive at least two different aqueous solutions. The at least one capillary valve is configured to allow for the at least two different aqueous solutions to be introduced into the at least one chamber without mixing prior to entering the at least one chamber based at least in part on pressure levels of the at least two different aqueous solutions.

19 Claims, 7 Drawing Sheets

(56) References Cited

U.S. PATENT DOCUMENTS

| | | | | |
|---|---|---|---|---|
| 8,772,046 | B2 | 7/2014 | Fraden | |
| 2012/0190127 | A1 | 7/2012 | Fraden | |
| 2016/0263577 | A1* | 9/2016 | Ismagilov | B01L 3/502738 |
| 2017/0268966 | A1 | 9/2017 | Fraden | |

OTHER PUBLICATIONS

Irimia, Daniel. "Capillary Force Valves." Encyclopedia of Microfluidics and Nanofluidics (2008): 192-196.

Shemesh, Jonathan, et al. "Stationary nanoliter droplet array with a substrate of choice for single adherent/nonadherent cell incubation and analysis." Proceedings of the National Academy of Sciences 111.31 (2014): 11293-11298.

Shim et al., "Using Microfluidics to Decouple Nucleation and Growth of Protein Crystals", Crystal Growth & Design 2007, vol. 7, No. 11, pp. 2192-2194.

* cited by examiner

DEVICES FOR SIMULTANEOUS GENERATION AND STORAGE OF ISOLATED DROPLETS, AND METHODS OF MAKING AND USING THE SAME

CROSS-REFERENCE TO RELATED APPLICATIONS

The present application represents the national stage entry of PCT International Application No. PCT/US2018/013877, filed on Jan. 16, 2018, and is based on, claims priority to, and incorporates herein by reference in its entirety, U.S. Provisional Patent Application No. 62/445,943, filed on Jan. 13, 2017, and entitled "Devices for Simultaneous Generation and Storage of Isolated Droplets, and Methods of Making and Using the Same."

STATEMENT REGARDING FEDERALLY SPONSORED RESEARCH

This invention was made with government support under award numbers 1534890 and 1209518 awarded by the National Science Foundation—Division of Materials Research. The government has certain rights in the invention.

BACKGROUND

1. Field of the Disclosure

This disclosure relates to a method for simultaneous generation and storage of isolated droplets of aqueous solutions.

2. Description of the Related Art

Existing methods of determining optimal concentrations for achieving the crystallization of various proteins include mixing macro-portions of multiple aqueous solutions. The mixtures are traditionally made by mixing the multiple aqueous solutions in testing trays, generally called crystallization trays. The testing trays have several mixture chambers, which contain the mixtures at various concentrations. These mixtures are then analyzed for protein crystallization. Often, due the macro-sized volume of these testing trays, it is cost prohibitive to test out multiple solution concentrations, as many types of proteins are exceedingly expensive.

SUMMARY

One aspect of the disclosure provides a microfluidic device comprising at least one isolation unit and at least one capillary valve. The at least one isolation unit has at least one chamber. The at least one chamber is configured to receive at least two different aqueous solutions. The at least one capillary valve is configured to allow for the at least two different aqueous solutions to be introduced into the at least one chamber without mixing prior to entering the at least one chamber based at least in part on pressure levels of the at least two different aqueous solutions.

In some forms, a relative volume of each of the at least two different aqueous solutions when introduced into the at least one chamber is determined by a location of a bypass capillary valve within the at least one chamber. The at least one chamber can be at least two chambers. The microfluidic device can further comprise a main channel, wherein the at least one chamber is in fluid communication with the main channel via the at least one capillary valve. The main channel can comprise an inlet, an outlet, an upstream portion, and a downstream portion. The upstream portion can be disposed between the inlet and the downstream portion, and the downstream portion can be disposed between the upstream portion and the outlet. The at least one capillary valve can include a first capillary valve, a second capillary valve, and a third capillary valve.

The microfluidic device can further comprise a first fluid path, a second fluid path, a third fluid path, and a bypass fluid path. The first fluid path can provide fluid communication between a first chamber of the at least two chambers and the upstream portion of the main channel. The first fluid path can include the first capillary valve. The first capillary valve can have a first pressure threshold. The second fluid path can provide fluid communication between the first chamber and a second chamber of the at least two chambers. The second fluid path can include the second capillary valve. The second capillary valve can have a second pressure threshold. The third fluid path can provide fluid communication between the second chamber and the downstream portion of the main channel. The third fluid path can include the third capillary valve. The third capillary valve can have a third pressure threshold. The bypass fluid path can provide fluid communication between one of the at least two chambers and the downstream portion of the main channel. The bypass fluid path can include the bypass capillary valve having a bypass pressure threshold. The bypass fluid path can provide fluid communication between the first chamber and the downstream portion. The bypass fluid path can connect to the first chamber upstream of the second fluid path. The bypass fluid path can provide fluid communication between the second chamber and the downstream portion.

The bypass fluid path can connect to the second chamber upstream of the third fluid path. The bypass fluid path can be positioned at a location wherein introducing a first aqueous solution of the at least two different aqueous solutions fills a first portion of the at least two chambers and subsequently introducing a non-aqueous fluid fills a second portion of the at least two chambers, thereby separating the first aqueous solution from the upstream portion of the main channel, and wherein introducing a second aqueous solution of the at least two different aqueous solutions fills the second portion of the at least two chambers and forces the non-aqueous fluid out of the at least two chambers through the bypass fluid path.

In some forms, the second pressure threshold can be greater than the first pressure threshold, and the third pressure threshold can be greater than the second pressure threshold, and the bypass pressure threshold can be greater than the second pressure threshold but less than the third pressure threshold.

The at least two chambers can further be at least three chambers including a first chamber, a second chamber, and a third chamber. In this case, the microfluidic device can comprise a first fluid path, a second fluid path, a third fluid path, a fourth fluid path, and a bypass fluid path. The first fluid path can provide fluid communication between the first chamber of the at least three chambers and the upstream portion of the main channel. The first fluid path can include the first capillary valve. The first capillary valve can have a first pressure threshold. The second fluid path can provide fluid communication between the first chamber and a second chamber of the at least three chambers. The second fluid path can include the second capillary valve. The second capillary valve can have a second pressure threshold. The third fluid path can provide fluid communication between the second chamber and the third chamber of the at least three chambers. The third fluid path can include the third capillary valve. The third capillary valve can have a third pressure threshold. The fourth fluid path can provide fluid communication between the third chamber and the downstream portion of the main channel. The fourth fluid path can include a fourth capillary valve. The fourth capillary valve can have a fourth pressure threshold. The bypass fluid path can provide fluid communication between one of the at least three chambers and the downstream portion of the main channel. The bypass fluid path can include the bypass capillary valve having a bypass pressure threshold.

In some forms, the second pressure threshold can be greater than the first pressure threshold, and the third pressure threshold can be greater than the second pressure threshold, and the fourth pressure threshold can be greater than the third pressure threshold, and the bypass pressure threshold can be greater than the third pressure threshold and less than the fourth pressure threshold.

The bypass fluid path can provide fluid communication between the first chamber and the downstream portion. The bypass fluid path can connect to the first chamber upstream of the second fluid path. The bypass fluid path can provide fluid communication between the second chamber and the downstream portion. The bypass fluid path can connect to the second chamber upstream of the third fluid path. The bypass fluid path can provide fluid communication between the third chamber and the downstream portion. The bypass fluid path can connect to the third chamber upstream of the fourth fluid path. The bypass fluid path can be positioned at a location wherein introducing a first aqueous solution of the at least two different aqueous solutions fills a first portion of the at least three chambers and subsequently introducing a non-aqueous fluid fills a second portion of the at least three chambers, thereby separating the first aqueous solution from the upstream portion of the main channel, and wherein introducing a second aqueous solution of the at least two different aqueous solutions fills the second portion of the at least three chambers and forces the non-aqueous fluid out of the at least three chambers through the bypass fluid path.

The first chamber can have a first volume and the second chamber can have a second volume that is larger than the first volume. The first chamber can have a first volume and the second chamber can have a second volume that is smaller than the first volume. The first chamber can have a first volume and the second chamber can have a second volume that is larger than the first volume. The first chamber can have a first volume and the second chamber can have a second volume that is smaller than the first volume. The third chamber can have a third volume that is larger than the second volume. The third chamber can have a third volume that is smaller than the second volume. The third chamber can have a third volume that is larger than the first volume. The third chamber can have a third volume that is smaller than the first volume. The at least one isolation unit can be at least four isolation units.

Another aspect of the disclosure provides a microfluidic device comprising at least one chamber configured to receive at least two different aqueous solutions and a non-aqueous fluid, wherein the at least two different aqueous solutions and the non-aqueous fluid are selectively introduced into the at least one chamber based on pressure levels of the at least two different aqueous solutions and the non-aqueous fluid so as to prevent mixing of the at least two different aqueous solutions prior to entering the at least one chamber.

Another aspect of the disclosure provides a microfluidic device comprising at least one chamber configured to receive at least two different aqueous solutions, wherein the at least two different aqueous solutions are selectively introduced into the at least one chamber based on a pressure level of the at least two different aqueous solutions.

Another aspect of the disclosure provides a microfluidic device comprising a main channel and an isolation unit. The main channel comprises an inlet, an outlet, an upstream portion, and a downstream portion. The isolation unit comprises a first chamber, a second chamber, a first fluid path, a second fluid path, a third fluid path, and a bypass fluid path. The first fluid path provides fluid communication between the upstream portion of the main channel and the first chamber and includes a first capillary valve. The second fluid path provides fluid communication between the first chamber and the second chamber and includes a second capillary valve. The third fluid path provides fluid communication between the second chamber and the downstream portion of the main channel and includes a third capillary valve. The bypass fluid path provides fluid communication between one of the first and second chambers and the downstream portion of the main channel and includes a bypass capillary valve.

Another aspect of the disclosure provides a microfluidic device comprising a main channel and an isolation unit. The main channel comprises an inlet, an outlet, an upstream portion, and a downstream portion. The isolation unit comprises at least one chamber, a first fluid path, a second fluid path, and a bypass fluid path. The first fluid path provides fluid communication between the upstream portion of the main channel and the at least one chamber and includes a first capillary valve. The second fluid path provides fluid communication between the at least one chamber and the downstream portion of the main channel and includes a second capillary valve. The bypass fluid path provides fluid communication between the at least one chamber and the downstream portion of the main channel and includes a bypass capillary valve, the bypass fluid path being positioned at a location wherein introducing a first aqueous solution fills the at least one chamber a first portion of the at least one chamber and the bypass fluid path allows a non-aqueous fluid to fill a second portion of the at least one chamber, thereby separating the first aqueous solution from the upstream portion of the main channel, and wherein introducing a second aqueous solution fills the at least one chamber the second portion of the volume of the at least one chamber and forces the non-aqueous fluid out of the at least one chamber through the bypass fluid path.

Another aspect of the disclosure provides a microfluidic device comprising at least one chamber configured to receive at least two different aqueous solutions and a non-aqueous fluid, wherein the at least two different aqueous solutions are selectively introduced into the at least one chamber based on a pressure level of the at least two different aqueous solutions with the non-aqueous fluid being introduced into the at least one chamber before and after each of the at least two different aqueous solutions at varying pressure levels so as to prevent mixing of the at least two different aqueous solutions prior to entering the at least one chamber.

Another aspect of the disclosure provides a method of isolating a mixture comprising at least two different aqueous solutions. The method comprises selectively introducing the at least two different aqueous solutions and a non-aqueous fluid into at least one chamber based on pressure levels of the at least two different aqueous solutions and the non-aqueous fluid so as to prevent mixing of the at least two different aqueous solutions prior to entering the at least one chamber.

In some forms, introducing the at least two different aqueous solutions and the non-aqueous fluid into at least one chamber can include introducing the at least two different aqueous solutions and the non-aqueous fluid into a first chamber of at least two chambers. Introducing the at least two different aqueous solutions and the non-aqueous fluid into the first chamber can comprise: a) introducing a first aqueous solution of the at least two different aqueous solutions into the first chamber at a first pressure; b) subsequent to step a), introducing the non-aqueous fluid into the first chamber at a second pressure; and c) subsequent to step b), introducing a second aqueous solution of the at least two different aqueous solutions into the first chamber at a third pressure. The second pressure can be greater than the first pressure and the third pressure can be greater than the first pressure but less than the second pressure.

Introducing the first aqueous solution into the first chamber at the first pressure can allow the first aqueous solution to pass through a first fluid path having a first capillary valve with a first pressure threshold that is lower than the first pressure. Introducing the non-aqueous fluid into the first chamber at the second pressure can force the first aqueous solution through a second fluid path having a second capillary valve with a second pressure threshold lower than the second pressure, but higher than the first pressure, into a second chamber of the at least two chambers. When the non-aqueous fluid is introduced into the first chamber, it can flow into the first chamber until it reaches a bypass fluid path at which point a first portion of the first chamber can be filled with the non-aqueous fluid. The bypass fluid path can have a bypass capillary valve with an aqueous bypass pressure threshold higher than the second pressure and a non-aqueous bypass pressure threshold lower than the second pressure. Once the non-aqueous fluid has filled the first portion and reaches the bypass valve, the non-aqueous fluid can begin to flow through the bypass fluid path. Introducing the second aqueous solution into the first chamber at the third pressure can force the non-aqueous fluid out of the first chamber, through the bypass fluid path, until the second aqueous solution has replaced the non-aqueous fluid in the first portion of the first chamber.

Another aspect of the disclosure provides a method of isolating a first aqueous solution and a second aqueous solution. The method comprises: a) introducing the first aqueous solution into an inlet of a microfluidic device at a first pressure, the first pressure greater than a first pressure threshold of a first capillary valve and less than a second pressure threshold of a second capillary valve; b) subsequent to step a), introducing a non-aqueous fluid into the inlet of the microfluidic device at a second pressure, the second pressure greater than the second pressure threshold and less than a third pressure threshold of a third capillary valve; c) subsequent to step b), introducing the second aqueous solution into the inlet of the microfluidic device at a third pressure, the third pressure greater than the first pressure threshold and less than the second pressure threshold; and d) subsequent to step c), introducing the non-aqueous fluid into the inlet of the microfluidic device at a fourth pressure, the fourth pressure greater than the first pressure threshold and less than the second pressure threshold.

Another aspect of the disclosure provides a method of isolating a first aqueous solution and a second aqueous solution. The method comprises: a) introducing the first aqueous solution into the inlet of the microfluidic device described herein at a first pressure; b) subsequent to step a), introducing a non-aqueous fluid into the inlet of the microfluidic device at a second pressure, the second pressure greater than the first pressure; c) subsequent to step b), introducing the second aqueous solution into the inlet of the microfluidic device at a third pressure, the third pressure less than the second pressure; d) subsequent to step c), introducing the non-aqueous fluid into the inlet of the microfluidic device at a fourth pressure, the fourth pressure less than the second pressure.

Another aspect of the disclosure provides a method of isolating a first mixture comprising a first aqueous solution and a second aqueous solution and a second mixture comprising a third aqueous solution and the second aqueous solution. The method comprises: a) introducing the first aqueous solution into the inlet of the microfluidic device described herein at a first pressure; b) subsequent to step a), introducing a non-aqueous fluid into the inlet of the microfluidic device at a second pressure, the second pressure greater than the first pressure; c) subsequent to step b), introducing the third aqueous solution into the inlet of the microfluidic device at a third pressure, the third pressure less than the second pressure; d) subsequent to step c), introducing the non-aqueous fluid into the inlet of the microfluidic device at a fourth pressure, the fourth pressure greater than the second pressure; e) subsequent to step d), introducing the second aqueous solution into the inlet of the microfluidic device at a fifth pressure, the fifth pressure greater than the second pressure.

Another aspect of the disclosure provides a method of isolating a mixture comprising at least two different aqueous solutions. The method comprises: a) introducing a first of the at least two different aqueous solutions into at least one chamber at a first pressure; b) subsequent to step a), introducing a non-aqueous fluid into the at least one chamber at a second pressure higher than the first pressure; c) subsequent to step b), introducing a second of the at least two different aqueous solutions into the at least one chamber at a third pressure.

Another aspect of the disclosure provides a method of isolating a mixture comprising at least two different aqueous solutions. The method comprises: a) introducing a first of the at least two different aqueous solutions into at least one chamber; b) subsequent to step a), introducing a non-aqueous fluid into the at least one chamber; c) subsequent to step b), introducing a second of the at least two different aqueous solutions into the at least one chamber.

Another aspect of the disclosure provides a method of isolating a mixture. The method comprises selectively introducing at least two different aqueous solutions into at least one chamber based on a pressure level of the at least two different aqueous solutions.

These and other features, aspects, and advantages of the present invention will become better understood upon consideration of the following detailed description, drawings and appended claims.

BRIEF DESCRIPTION OF THE DRAWINGS

Like reference numerals will be used to refer to like parts from FIG. 1 to FIG. 11 in the following description of the drawings.

DETAILED DESCRIPTION

Figure 1:
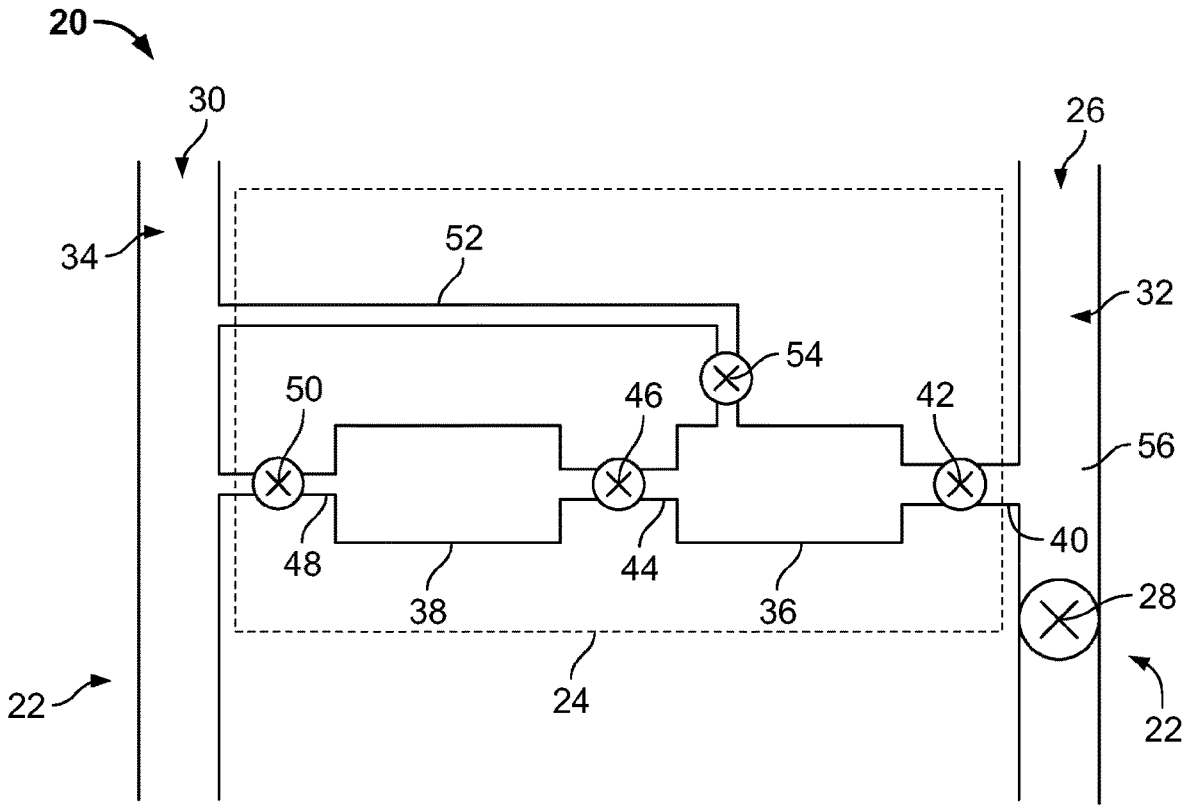
FIG. 1 is a schematic of the microfluidic device.

Before the present invention is described in further detail, it is to be understood that the invention is not limited to the particular aspects described. It is also understood that the terminology used herein is for the purpose of describing particular aspects only, and is not intended to be limiting. The scope of the present invention will be limited only by the claims. As used herein, the singular forms "a", "an", and "the" include plural embodiments unless the context clearly dictates otherwise.

Specific structures, devices and methods relating to isolating droplets are disclosed. It should be apparent to those skilled in the art that many additional modifications beside those already described are possible without departing from the inventive concepts. In interpreting this disclosure, all terms should be interpreted in the broadest possible manner consistent with the context.

Variations of the term "comprising" should be interpreted as referring to elements, components, or steps in a non-exclusive manner, so the referenced elements, components, or steps may be combined with other elements, components, or steps that are not expressly referenced. Aspects referenced as "comprising" certain elements are also contemplated as "consisting essentially of" and "consisting of" those elements.

Numeric ranges disclosed herein are inclusive of the end values. For example, recitation of a value of between 1 and 10 includes the values 1 and 10. When two or more ranges for a particular value are recited, this disclosure contemplates all combinations of the upper and lower bounds of those ranges that are not explicitly recited. For example, recitation of a value of between 1 and 10 or between 2 and 9 also contemplates a value of between 1 and 9 or between 2 and 10.

The various aspects may be described herein in terms of various functional components and processing steps. It should be appreciated that such components and steps may be realized by any number of hardware components configured to perform the specified functions. Unless the context clearly dictates otherwise, aspects of the present disclosure described with respect to devices are applicable to the methods, and vice versa, and aspects described with respect to one method are applicable to other methods.

As used herein, the term "solution" refers to the traditional meaning of solution (in other words, a solvent that has a solute dissolved in it), but should also be interpreted to encompass mixtures, suspensions, neat fluids, and other liquids with or without other components, unless the context clearly dictates otherwise. For clarity, the term "solution" can be used to describe a solvent with a solute dissolved in it, a solvent with a species suspended within it, and a pure fluid.

This disclosure provides microfluidic devices and methods of making and using the same. Systems and methods of the present disclosure utilize capillary valves, and particularly the differential pressure thresholds for aqueous fluids versus other fluids, to isolate droplets of liquid. The isolated droplets can be a single aqueous fluid or solution or a mixture of two or more aqueous fluids or solutions. Each microfluidic device can include a multitude of isolation units. The various isolation units can each have a different configuration in order to provide a multitude of reaction conditions.

Devices

Referring to FIG. 1 this disclosure provides a microfluidic device 20. The microfluidic device 20 can include a main channel 22 and a first isolation unit 24. The main channel 22 can include an inlet 26, a first main channel capillary valve 28 having a first main channel pressure threshold, an outlet 30, an upstream portion 32, and a downstream portion 34.

The first isolation unit 24 can include a first chamber 36 and a second chamber 38. Between the upstream portion 32 of the main channel 22 and the first chamber 36 of the first isolation unit 24, there can be a first fluid path 40 providing fluid communication between the upstream portion 32 and the first chamber 36. The first fluid path 40 can include a first capillary valve 42 having a first aqueous pressure threshold.

Between the first chamber 36 of the first isolation unit 24 and the second chamber 38 of the first isolation unit 24, there can be a second fluid path 44 providing fluid communication between the first chamber 36 and the second chamber 38. The second fluid path 44 can include a second capillary valve 46 having a second aqueous pressure threshold. Between the second chamber 38 of the first isolation unit 24 and the downstream portion 34 of the main channel 22 there can be a third fluid path 48 providing fluid communication between the second chamber 38 and the downstream portion 34. The third fluid path 48 can include a third capillary valve 50 having a third aqueous pressure threshold. There can further be a fourth fluid path 52 extending between and providing fluid communication between the first chamber 36 of the first isolation unit 24 and the downstream portion 34 of the main channel 22. The fourth fluid path 52 can include a fourth capillary valve 54 having a fourth aqueous pressure threshold.

In certain applications, the aqueous pressure thresholds of the various capillary valves discussed above can have various relations to one another in order to achieve certain effects. In one aspect, the first aqueous pressure threshold can be lower than the second, third and fourth aqueous pressure thresholds. The second aqueous pressure threshold can be greater than the first aqueous pressure threshold and lower than the third and fourth aqueous pressure thresholds. The third and fourth aqueous pressure thresholds can be equal to each other. The first main channel pressure threshold can be greater than the first aqueous pressure threshold and lower than the second, third, and fourth aqueous pressure thresholds.

Each of the capillary valves 28, 42, 46, 50, 54 discussed above have corresponding non-aqueous pressure thresholds, which tend to be much lower than the corresponding aqueous pressure thresholds. These lower non-aqueous pressure thresholds are due to suitable non-aqueous fluids having significantly lower surface tensions than the surface tensions of typical aqueous solutions.

Figure 10:
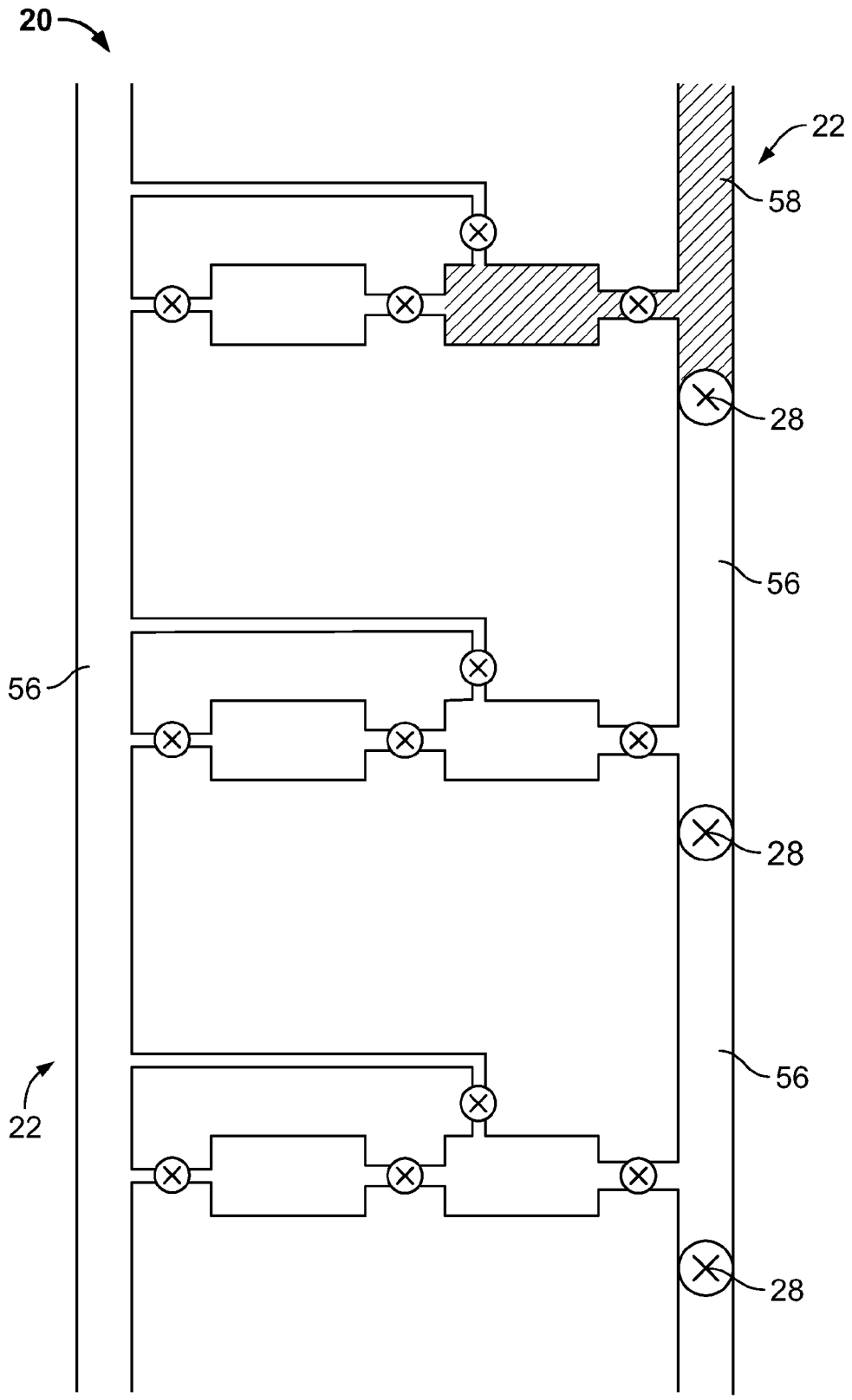
FIG. 10 is a schematic of the microfluidic device of FIG. 1, shown with multiple isolation units and the aqueous solution filling the first chamber of the first isolation unit.
Figure 11:
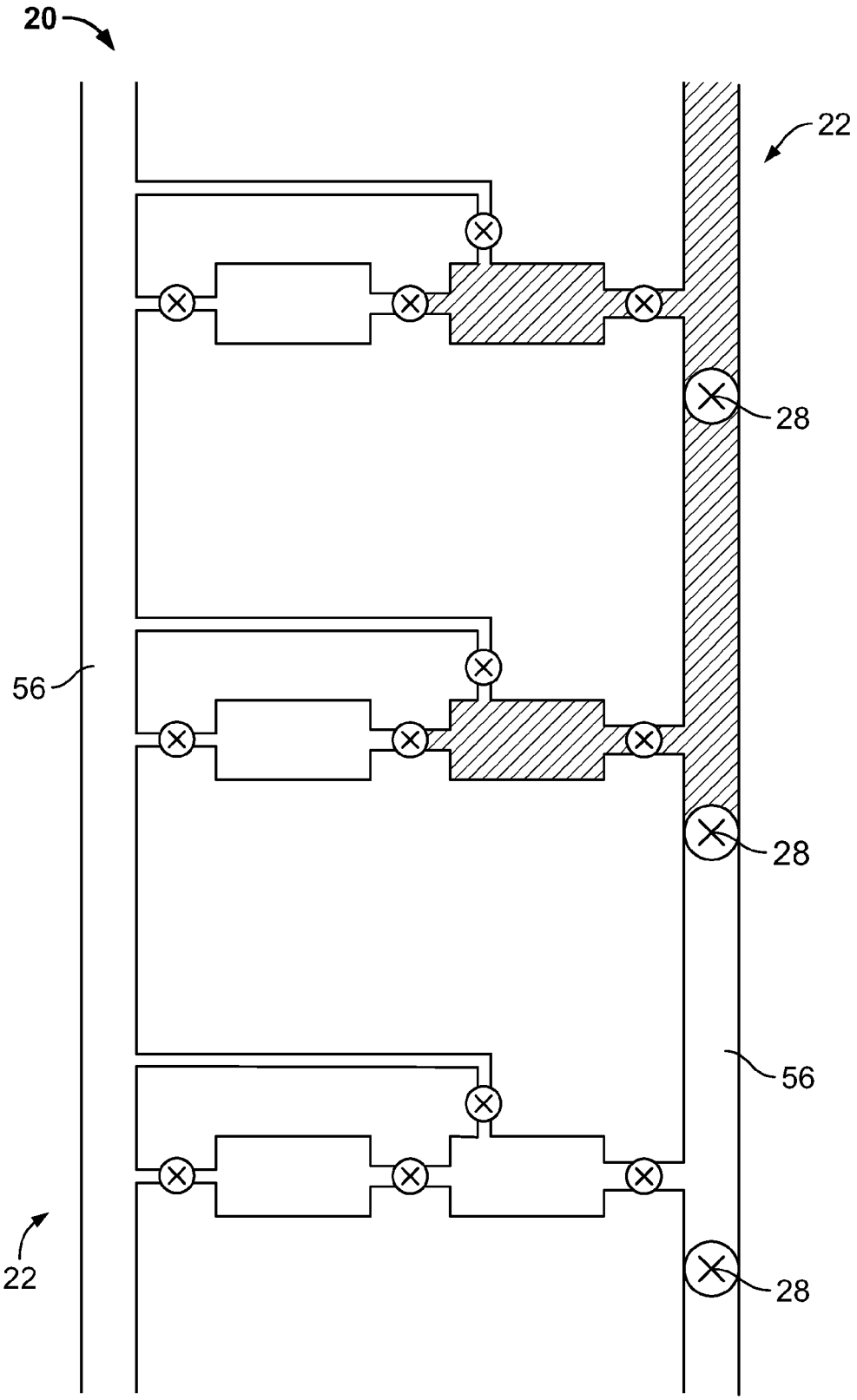
FIG. 11, is the schematic of the microfluidic device of FIG. 10, shown with the aqueous solution filling the first chamber of each of the first isolation unit and the second isolation unit.

It should be appreciated that the microfluidic device 20 can comprise any number of isolation units (e.g. first isolation unit, second isolation unit, third isolation unit, etc.), each in fluid communication with the main channel 22, as shown in FIGS. 10 and 11. The isolation units can be identical or non-identical to achieve certain effects. Further, between the isolation units, the microfluidic device 20 can have corresponding main channel capillary valves (e.g. the first main channel capillary valve 28, a second main channel capillary valve, a third main channel capillary valve, etc.), associated with the isolation units. Each of the main channel capillary valves may have corresponding main channel pressure thresholds (e.g. the first main channel pressure threshold, a second main channel pressure threshold, a third main channel pressure threshold, etc.) within the main channel 22 creating pressure-dependent barriers between each isolation unit, as shown in FIGS. 10 and 11, to allow for the sequential filling of the isolation units, discussed in detail below.

In certain aspects, the device 10 can further include a third chamber and a fifth capillary valve. The third capillary valve 50 can be disposed between the second chamber 38 and the third chamber. The third chamber can be disposed between the third capillary valve 50 and the fifth capillary valve. The fifth capillary valve can be disposed between the third chamber and the downstream portion 34 of the main channel 22. The fifth capillary valve can have a fifth aqueous pressure threshold.

In certain aspects, the first chamber 36, the second chamber 38, the third chamber can have the same or different volumes relative to one another. In certain aspects, the first chamber 36, the second chamber 38, and/or the third chamber can have a volume of between 10 pL and 10 mL, including but not limited to, a volume of between 1 nL and 1 mL, or between 10 nL and 100 nL.

The microfluidic device 20 can have an interior composed of a material selected from a wide range of thermosets. For example, the interior can be composed of a material selected from the group consisting of epoxies, elastomers, such as urethanes, polystyrene, cyclic olefin copolymer, polydimethyl siloxane, Teflon, other materials known to those having ordinary skill in the art to be suitable for microfluidic applications such as those described herein, and combinations thereof.

This disclosure also provides kits including the microfluidic device 20 and a fluid source. The fluid source can be coupled to the inlet 26. The fluid source can be configured to introduce aqueous solutions and non-aqueous fluids to the inlet 26 at variable pressures. The fluid source can be any device capable of moving a fluid through a microfluidic device 20, including but not limited to, various pumps, pipettes, and the like. In certain aspects, the fluid source can be a variable pressure fluid source. In certain aspects, the fluid source can be a plurality of distinct fluid sources that can provide fluid at different pressures. The kits described herein can also include information accompanying the microfluidic device 20 that describes the various pressure thresholds associated with the microfluidic device 20.

Methods

Figure 9:
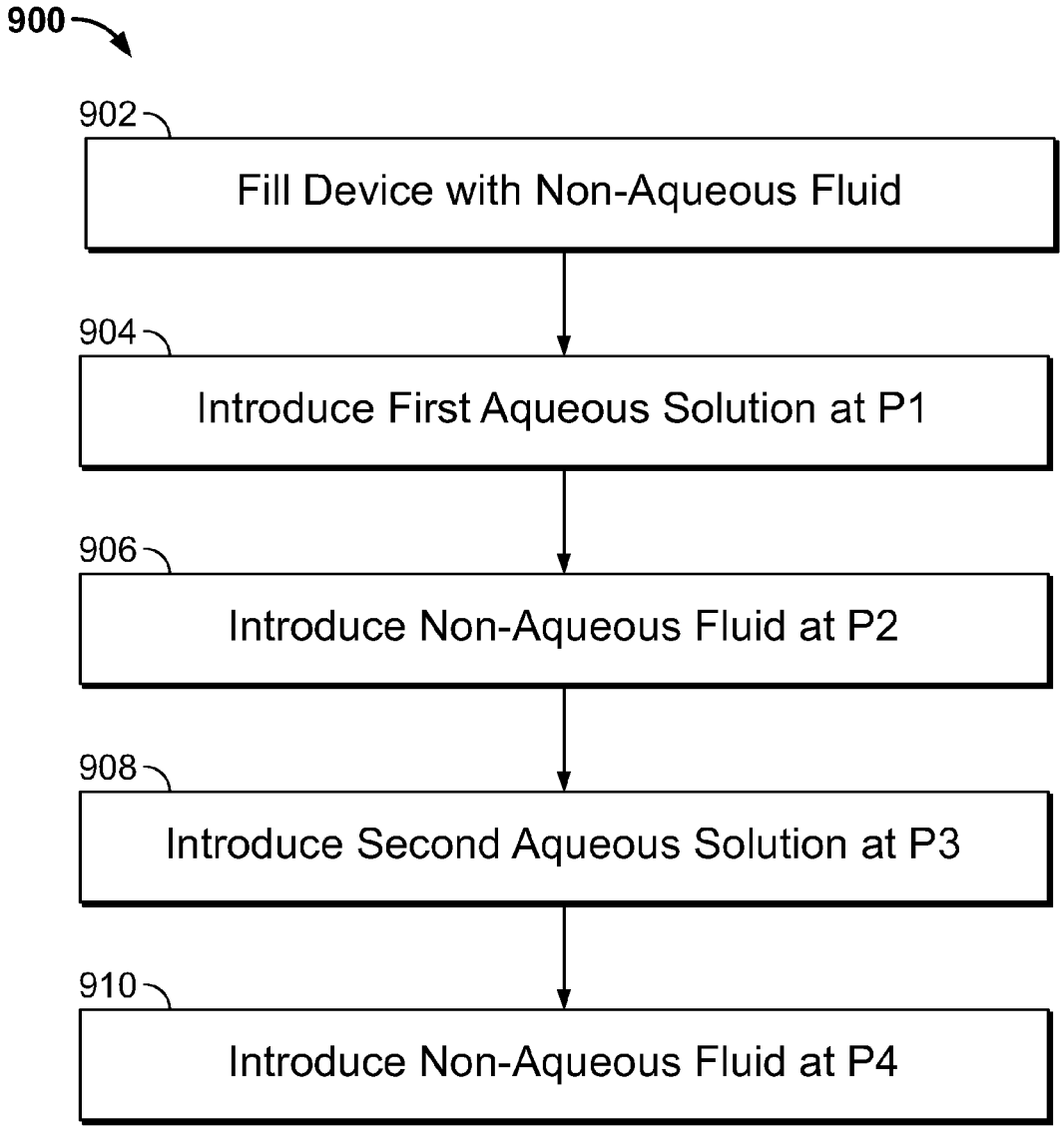
FIG. 9 is a method flowchart for isolating droplet(s) of aqueous mixtures using the microfluidic device shown in FIGS. 1-8.

Referring to FIG. 9, this disclosure provides a method of operation 900 of a microfluidic device 20. At process block 902, the method of operation 900 can include filling the microfluidic device 20 with a non-aqueous fluid 56. At process block 904, the method of operation 900 can include introducing a first aqueous solution 58 into the inlet 26 of the main channel 22 at a first pressure P1. At process block 906, the method of operation 900 can include introducing the non-aqueous fluid 56 into the inlet 26 of the main channel 22 at a second pressure P2. At process block 908, the method of operation 900 can include introducing a second aqueous solution 60 at a third pressure P3. At process block 910, the method of operation 900 can include a fifth method step of introducing the non-aqueous fluid 56 at a fourth pressure P4.

In certain applications, the method steps discussed above can be executed with the first, second, third, and fourth pressures P1, P2, P3, P4 corresponding to the various pressure thresholds of the capillary valves 42, 46, 50, 54 of the microfluidic device 20 to achieve certain effects.

Figure 2:
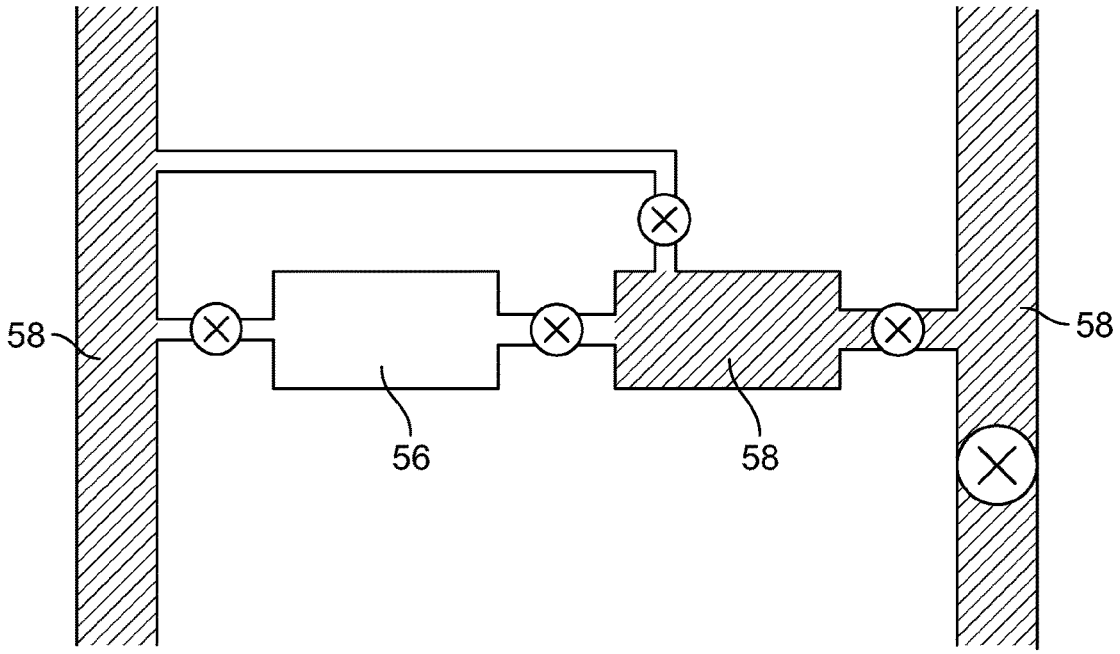
FIG. 2 is the schematic of the microfluidic device of FIG. 1, shown with the first aqueous solution filling the main channel and the first chamber of the first isolation unit.

In an aspect, FIGS. 1-6 illustrate the microfluidic device 20 at various time slices during execution of the method of operation 900. During the first method step, the microfluidic device 20 can be filled with the non-aqueous fluid 56. The non-aqueous fluid 56 can be selected from a group consisting of a gaseous fluid, an oil, a liquid metal (for example, mercury or gallium), and combinations thereof. As shown in FIG. 2, during the second method step, a first aqueous solution 58 can be introduced into the inlet 26 of the main channel 22 at a first pressure P1, which is greater than the first aqueous pressure threshold of the first capillary valve 42. The first aqueous solution 58 flows from the inlet 26 through at least part of the upstream portion 32, then the first aqueous solution 58 flows through the first fluid path 40 (passing through the first capillary valve 42), and begins to fill the first chamber 36 of the first isolation unit 24. As the first aqueous solution 58 flows into the first chamber 36 at the first pressure P1, the non-aqueous fluid 56 flows out of the first chamber 36 through the second and fourth fluid paths 44, 52 because the second and fourth capillary valves 46, 54 have second and fourth non-aqueous pressure thresholds which are lower than the first pressure P1. As the first aqueous solution 58 fills the first chamber 36, effectively replacing the non-aqueous fluid 56, the first aqueous solution 58 does not flow through the second and fourth fluid paths 44, 52 because the first pressure P1 is lower than the second and fourth aqueous pressure thresholds of the second and fourth capillary valves 46, 54.

Additionally, in some aspects the main channel 22 can include the main channel capillary valve 28. The main channel capillary valve 28 can have a main channel pressure threshold that is greater than the first aqueous pressure threshold, but lower than the first pressure P1. Due to the higher main channel pressure threshold in these aspects, the first aqueous solution 58 flows first into the first chamber 36 of the first isolation unit 24, as shown in FIG. 10. When the first chamber 36 is filled, the first aqueous solution 58 flows through the main channel capillary valve 28, through the main channel 22, either out of the main channel 22, or to a second isolation unit, as shown in FIG. 11. In this regard, multiple isolation units separated by multiple main channel capillary valves can filled sequentially.

Further, it will be appreciated by those skilled in the art that with multiple isolation units being filled sequentially, it is possible to introduce a predetermined amount of the first aqueous solution 58 into the main channel 22, such that the first aqueous solution 58 does not fill all of the multiple first chambers 36 of the multiple isolation units. For example, if the first chamber 36 of each isolation unit holds 10 nL of liquid, and there are ten isolation units in the microfluidic device, if 50 nL of the first aqueous solution 58 are introduced into the main channel 22, the first aqueous solution 58 will fill the first chambers 36 of the first five isolation units, with the remaining five isolation units still containing the non-aqueous fluid 56. Additionally, after the first aqueous solution 58 has filled the first chambers 36 of the first five isolation units, 50 nL of a third aqueous solution can be introduced into the main channel 22. In this case, the first aqueous solution 58 can block the third aqueous solution from entering the first chambers 36 of the first five isolation units. Then the third aqueous solution can sequentially fill the first chambers 36 of the remaining five isolation units.

To introduce multiple aqueous solutions and non-aqueous fluids into the microfluidic device 20, a tube containing pre-measured amounts of the various liquids may be used. The tube can contain a multitude of varying aqueous solutions separated by non-aqueous fluids, such that the first chambers 36 of the various isolation units can be filled with a multitude of varying aqueous solutions, as described above.

Figure 3:
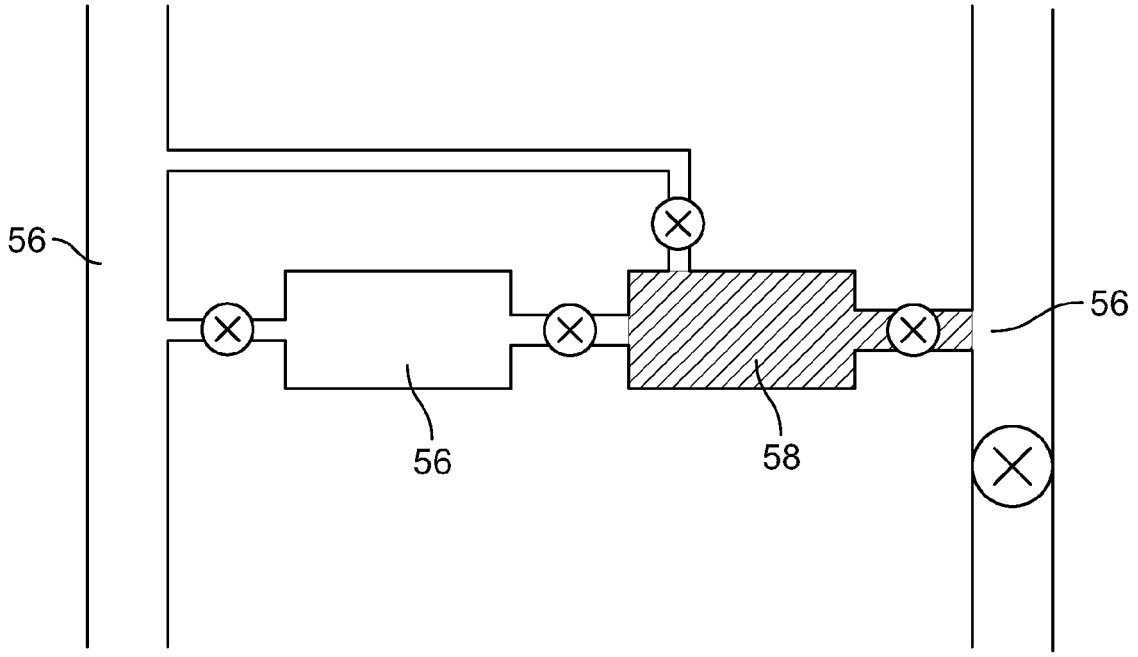
FIG. 3 is the schematic of the microfluidic device of FIG. 1, shown with the first aqueous solution filling the first chamber of the first isolation unit.

As shown in FIG. 3, during the third method step, the non-aqueous fluid 56 is introduced into the inlet 26 of the main channel 22 at a second pressure P2, which is greater than the first and second aqueous pressure thresholds, but lower than the third and fourth aqueous pressure thresholds. As the non-aqueous fluid 56 flows through the inlet 26 and the upstream portion 32 it pushes the first aqueous solution 58 through the main channel 22. The non-aqueous fluid 56 continues to push the first aqueous solution 58 past the first fluid path 40, through the first main channel capillary valve 28, through the downstream portion 34, and out of the outlet 30 of the main channel 22. At this point, the non-aqueous fluid 56 completely fills the main channel 22, effectively purging the first aqueous solution 58 from the main channel 22.

Figure 4:
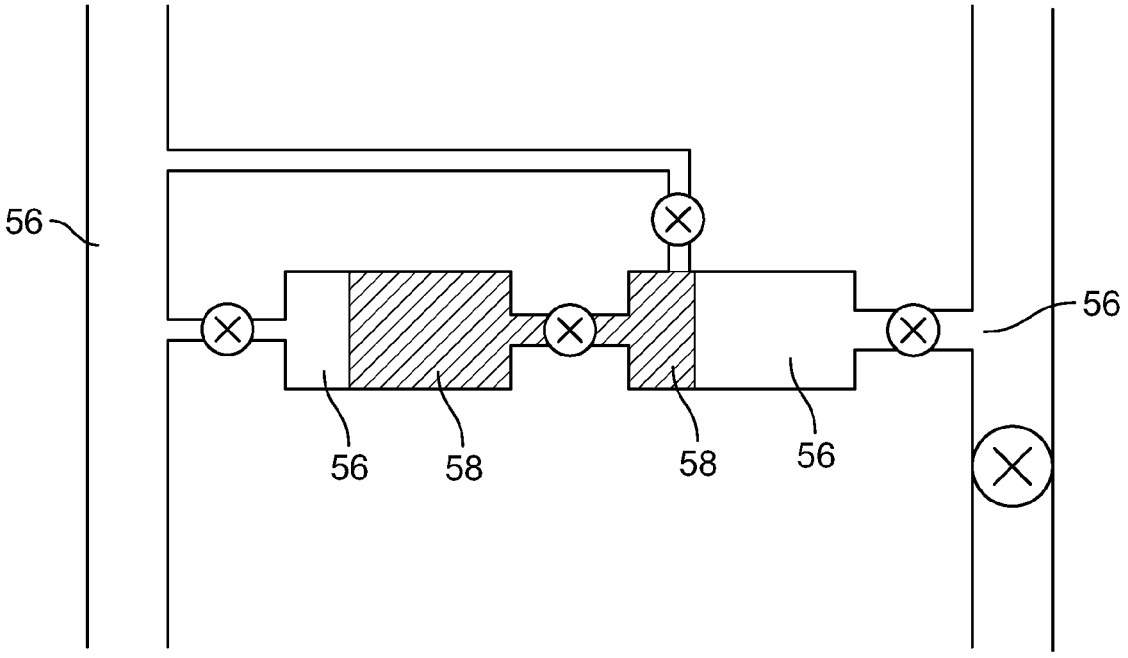
FIG. 4 is the schematic of the microfluidic device of FIG. 1, shown with the first aqueous solution partially filling each of the first and second chambers of the first isolation unit.

As shown in FIG. 4, once the non-aqueous fluid 56 purges the main channel 22 of the first aqueous solution 58, it begins to flow into the first chamber 36 of the first isolation unit 24. As the non-aqueous fluid 56 flows into the first chamber 36 at the second pressure P2, the first aqueous solution 58 begins to flow through the second fluid path 44 (passing through the second capillary valve 46), and into the second chamber 38. The non-aqueous fluid 56 flows through the first fluid path 40 (passing through the first capillary valve 42) and continues to push the first aqueous solution 58 into the second chamber 38 until the non-aqueous fluid 56 reaches the fourth fluid path 52. The fourth non-aqueous pressure threshold of the fourth capillary valve 54 is lower than the second pressure P2, therefore the non-aqueous fluid 56 is allowed to pass through the fourth capillary valve 54, through the fourth fluid path 52, and into the downstream portion 34 of the main channel 22. For this reason, the non-aqueous fluid 56 does not continue pushing the first aqueous solution 58 once it reaches the fourth fluid path 52.

Figure 5:
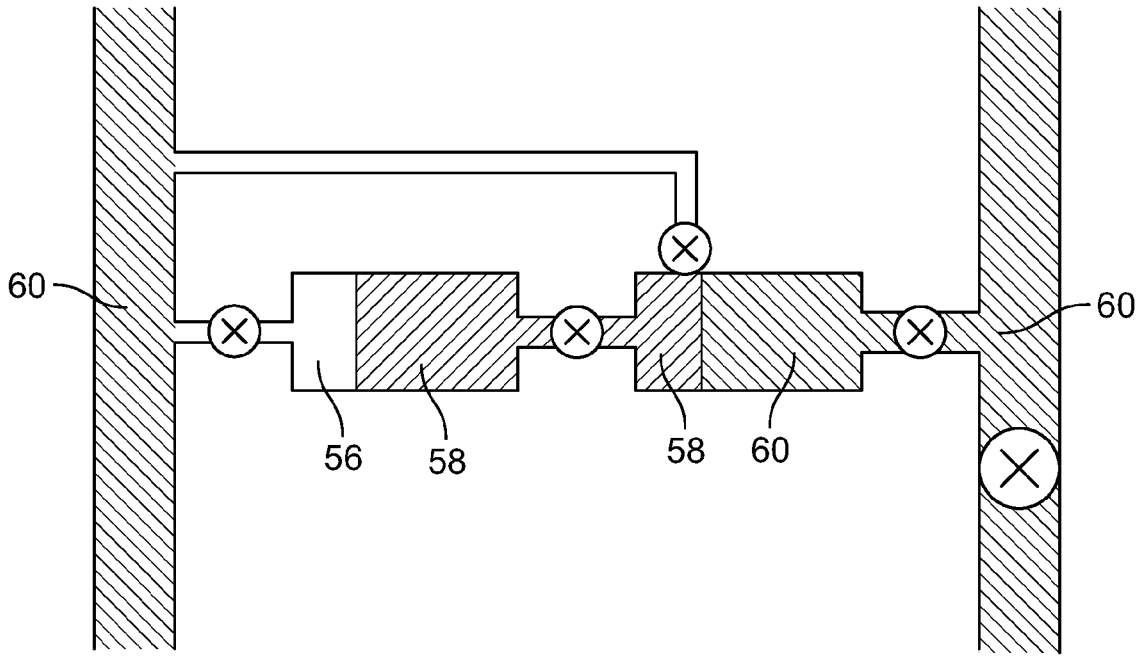
FIG. 5 is the schematic of the microfluidic device of FIG. 1, shown with the first aqueous solution partially filling each of the first and second chambers of the first isolation unit, and the second aqueous solution filling the main channel and the rest of the first chamber of the first isolation unit.

As shown in FIG. 5, during the fourth method step, a second aqueous solution 60 is introduced into the inlet 26 of the main channel 22 at a third pressure P3, which is greater than the first aqueous pressure threshold, but lower than the second, third, and fourth aqueous pressure thresholds. The second aqueous solution 60 flows from the inlet 26, through the upstream portion 32, through the downstream portion 34, and out of the outlet 30, completely filling the main channel 22. Again, because the first main channel pressure threshold of the first main channel capillary valve 28 is greater than the first aqueous pressure threshold, the second aqueous solution 60 flows through the first fluid path 40 (passing through the first capillary valve 42), and into the first chamber 36 of the first isolation unit 24 before passing through the first main channel capillary valve 28 to fill the rest of the main channel 22.

As the second aqueous solution 60 flows into the first chamber 36, the non-aqueous fluid 56 is continuously allowed to flow through the fourth fluid path 52 (passing through the fourth capillary valve 54), into the downstream portion 34 of the main channel 22. Once the second aqueous solution 60 reaches the fourth fluid path 52, it has effectively replaced the non-aqueous fluid 56 within the first chamber 36. The first and second aqueous solutions 58, 60 do not flow through the second and fourth fluid paths 44, 52 because the second and fourth aqueous pressure thresholds are greater than the third pressure P3. At this point the second chamber 38 is partially filled by the first aqueous solution 58, and the first chamber 36 is completely filled, partially by the first aqueous solution 58 and partially by the second aqueous solution 60.

In the illustrated aspect, the second aqueous solution 60 fills approximately eighty percent of the first chamber 36 with the rest of the first chamber 36 being filled by the first aqueous solution 58. In other aspects, the second aqueous solution 60 could fill between more or less than eighty percent of the first chamber 36 to achieve a desired concentration of the second aqueous solution 60 relative to the first aqueous solution 58.

The desired concentration of the second aqueous solution 60 relative to the first aqueous solution 58 may be achieved by positioning the fourth fluid path 52 within the first chamber 36 between the first and second fluid paths 40, 44 such that when the non-aqueous fluid 56 flows into the first chamber 36 at the second pressure P2, during the third method step, it fills a desired percentage of the first chamber 36 before beginning to flow through the fourth fluid path 52. The desired percentage of the first chamber 36 filled by the non-aqueous fluid 56 is then replaced by the second aqueous solution 60, during the fourth method step, giving the first chamber 36 the desired concentration of the second aqueous solution 60 relative to the first aqueous solution 58.

Additionally, it will be appreciated by those skilled in the art that the fourth fluid path 52 may be positioned within the second chamber 38 or the third chamber, instead of the first chamber 36, depending on the intended use, to achieve certain affects.

Figure 6:
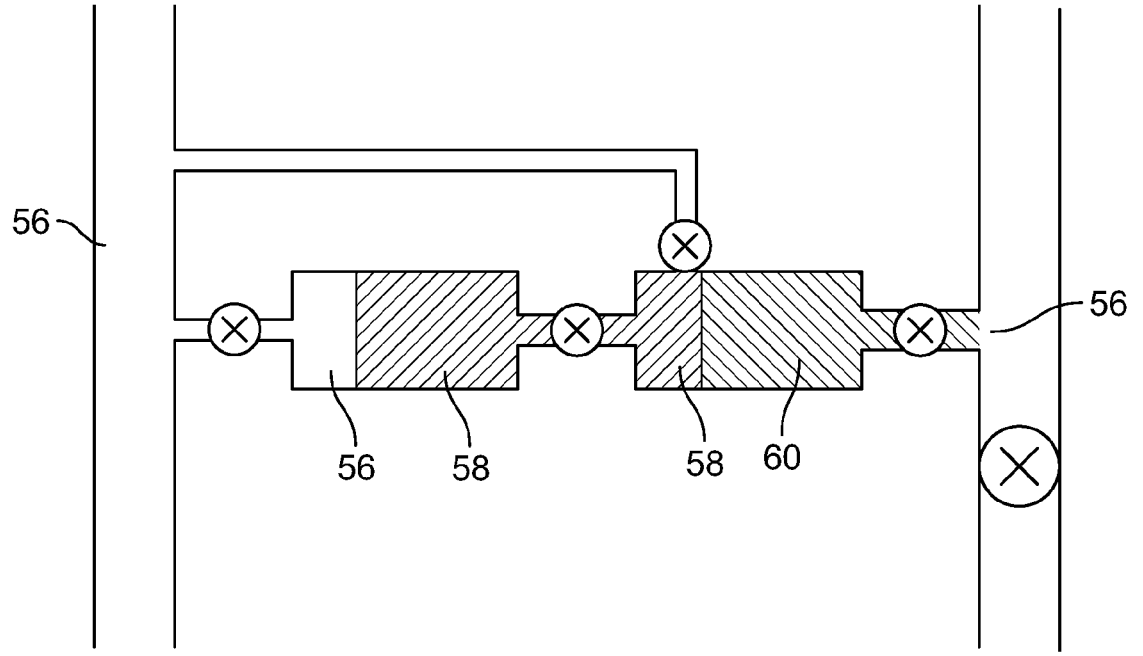
FIG. 6 is the schematic of the microfluidic device of FIG. 1, shown with the first aqueous solution partially filling each of the first and second chambers of the first isolation unit, and the second aqueous solution filling the rest of the first chamber of the first isolation unit.

As shown in FIG. 6, during the fifth method step, the non-aqueous fluid 56 is introduced into the inlet 26 of the main channel 22 at a fourth pressure P4. The fourth pressure P4 is greater than the first aqueous pressure threshold, but less than the second, third, and fourth aqueous pressure thresholds. The non-aqueous fluid 56 flows from the inlet 26, through the upstream portion 32, through the downstream portion 34, and out of the outlet 30, completely filling the main channel 22 and effectively purging the main channel 22 of the second aqueous solution 60. Once the non-aqueous fluid 56 fills the main channel 22, it does not begin to flow into the first fluid path 40 because the fourth pressure P4 is lower than the second and fourth aqueous pressure thresholds, therefore the first and second aqueous solutions 58, 60 are unable to flow through the second and fourth fluid paths 44, 52, and effectively block the non-aqueous fluid 56 from entering the first chamber 36.

In an aspect, FIGS. 1-6 illustrate the microfluidic device 20 at various time slices during execution of the method of operation 900. In this aspect the first through fifth method steps happen as described above with a slight variation to the second method step, as discussed below.

In this aspect, the main channel 22 does not include the first main channel capillary valve 28 (or any other main channel capillary valves). As such, during the second method step, the first aqueous solution 58 can be introduced into the inlet 26 of the main channel 22 at the first pressure P1, which is greater than the first aqueous pressure threshold of the first capillary valve 42. The first aqueous solution 58 flows from the inlet 26 through the upstream portion 32, through the downstream portion 34, and out of the outlet 30, completely filling the main channel 22. Then, once the main channel 22 is filled with the first aqueous solution 58 at the first pressure P1, the first aqueous flows through the first fluid path 40 (passing through the first capillary valve 42), and begins to fill the first chamber 36 of the first isolation unit 24. From this point on, the second through fifth method steps occur as described above.

In an aspect, FIGS. 1-5, 7, and 8 illustrate the microfluidic device 20 at various time slices during execution of the method of operation 900. In this aspect, the first through third method steps (corresponding to FIGS. 1-4) happen as described above.

Figure 7:
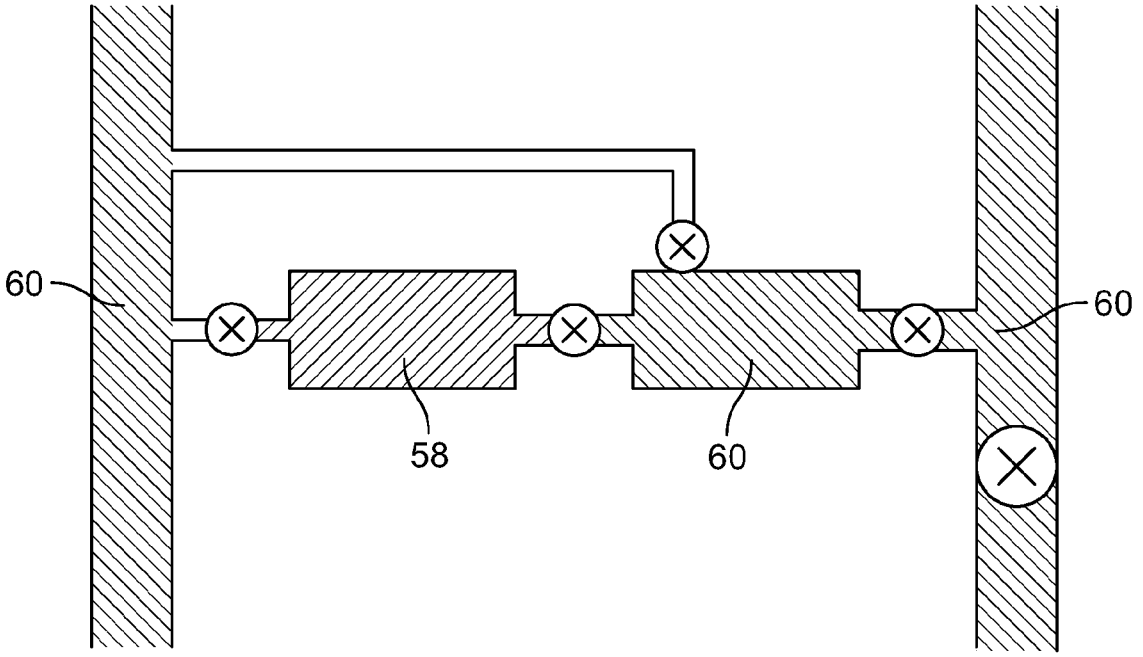
FIG. 7 is the schematic of the microfluidic device of FIG. 1, shown with the first aqueous solution filling the second chamber of the first isolation unit, and the second aqueous solution filling main channel and the first chamber of the first isolation unit.

As shown in FIGS. 5 and 7, during the fourth method step, the second aqueous solution 60 is introduced into the inlet 26 of the main channel 22 at the third pressure P3. In this aspect, the third pressure P3 is greater than both the first and second aqueous pressure thresholds, but lower than the third and fourth aqueous pressure thresholds. The second aqueous solution 60 flows from the inlet 26, through the upstream portion 32, through the downstream portion 34, and out of the outlet 30, completely filling the main channel 22. Once the main channel 22 is filled with the second aqueous solution 60 at the third pressure P3, the second aqueous solution 60 flows through the first fluid path 40 (passing through the first capillary valve 42), and into the first chamber 36 of the first isolation unit 24. As the second aqueous solution 60 flows into the first chamber 36, the non-aqueous fluid 56 is continuously allowed to flow through the fourth fluid path 52 (passing through the fourth capillary valve 54), into the downstream portion 34 of the main channel 22. Once the second aqueous solution 60 reached the fourth fluid path 52, it has effectively replaced the non-aqueous fluid 56 within the first chamber 36. At this point, because the third pressure P3 is greater than the second aqueous pressure threshold, the first aqueous solution 58 is allowed to pass through the second fluid path 44 (through the second capillary valve 46), and further enter the second chamber 38 of the first isolation unit 24. Once the second chamber 38 is completely filled by the first aqueous solution 58, or a mixture of the first and second aqueous solutions 58, 60 as discussed below, the first isolation unit 24 is completely filled, and neither the first aqueous solution 58 nor the second aqueous solution 60 are allowed to flow through the third or fourth fluid paths 48, 52 because the third pressure P3 is lower than both the third and fourth aqueous pressure thresholds.

In the illustrated aspect, the first aqueous solution 58 fills approximately one hundred percent of the second chamber 38. In other aspects, the first aqueous solution 58 could fill less than one hundred percent of the second chamber 38, with the rest of the second chamber 38 being filled by the second aqueous solution 60, to achieve a desired concentration of the first aqueous solution 58 relative to the second aqueous solution 60.

In the illustrated aspect, the second aqueous solution 60 fills approximately one hundred percent of the first chamber 36. In other aspects, the second aqueous solution 60 could fill less than one hundred percent of the first chamber 36, with the rest of the first chamber 36 being filled by the first aqueous solution 58, to achieve a desired concentration of the second aqueous solution 60 relative to the first aqueous solution 58.

During the fourth method step, after the second aqueous solution 60 has effectively replaced the non-aqueous fluid 56 within the first chamber 36, and pushed the first aqueous solution 58 until the second chamber 38 is completely filled, the volume of the first chamber 36 relative to the second chamber 38 ultimately determines the concentration of the first and second aqueous solutions 58, 60 relative to one another within the first and second chambers 36, 38. For example, if the first chamber 36 is two-hundred percent of the volume of the second chamber 38, after the fourth method step, the second chamber 38 would be completely filled with the first aqueous solution 58, and the first chamber 36 would be filled with a mixture composed of fifty percent the first aqueous solution 58 and fifty percent the second aqueous solution 60. Alternatively, if the first chamber 36 is fifty percent of the volume of the second chamber 38, after the fourth method step, the first chamber 36 would be completely filled with the second aqueous solution 60, and the second chamber 38 would be filled with a mixture composed of fifty percent the first aqueous solution 58 and fifty percent the second aqueous solution 60. As such, in this aspect, the desired concentrations of the first and second aqueous solutions 58, 60 relative to one another within the first and second chambers 36, 38 may be achieved by sizing the first and second chambers 36, 38 accordingly.

Figure 8:
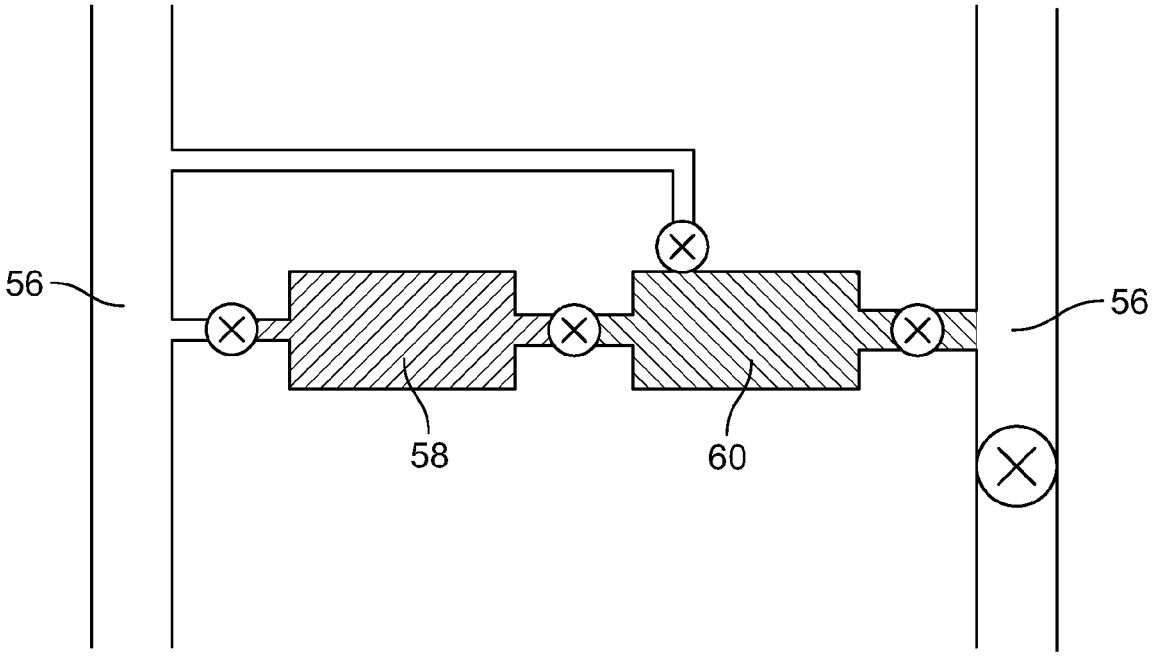
FIG. 8 is the schematic of the microfluidic device of FIG. 1, shown with the first aqueous solution filling the second chamber of the first isolation unit, and the second aqueous solution filling the first chamber of the first isolation unit.

As shown in FIG. 8, during the fifth method step, the non-aqueous fluid 56 is introduced into the inlet 26 of the main channel 22 at the fourth pressure P4. Again, the fourth pressure P4 is greater than the first and second aqueous pressure thresholds, but less than the third and fourth aqueous pressure thresholds. The non-aqueous fluid 56 flows from the inlet 26, through the upstream portion 32, through the downstream portion 34, and out of the outlet 30, completely filling the main channel 22 and effectively purging the main channel 22 of the second aqueous solution 60. Once the non-aqueous fluid 56 fills the main channel 22, it does not begin to flow into the first fluid path 40 because the fourth pressure P4 is lower than the third and fourth aqueous pressure thresholds, therefore the first and second aqueous solutions 58, 60 are unable to flow through the third and fourth fluid paths 48, 52, and effectively block the non-aqueous fluid 56 from entering the first chamber 36.

After the fifth method step, the first isolation unit 24 can contain an isolated droplet of the aqueous mixture composed of the first aqueous solution 58 and the second aqueous solution 60 with the desired concentration of the first aqueous solution 58 relative to the second aqueous solution 60.

There are several methods of making the above described microfluidic device 20. The microfluidic device 20 can, for example, be made as a two piece device having a body, including the various chambers and fluid paths described above formed into an exterior surface of the body, and a cover that is then affixed or coupled to the body, such that the various chambers and fluid paths are sealed. The body can be formed using a single-step process. For example, the body can be formed using injection molding, compression molding, or any other suitable single-step process. The body can also be formed using a two-step process. For example, the body can be formed by first forming a blank structure using extrusion, injection molding, compression molding, or any other suitable process, and then forming the various chambers and fluid paths into the exterior surface through laser etching, milling, chemical etching, or any other suitable subtractive manufacturing process.

The disclosure therefore provides a microfluidic device comprising at least one isolation unit and at least one capillary valve. The at least one isolation unit has at least one chamber. The at least one chamber configured to receive at least two different aqueous solutions. The at least one capillary valve is configured to allow for the at least two different aqueous solutions to be introduced into the at least one chamber without mixing prior to entering the at least one chamber based at least in part on pressure levels of the at least two different aqueous solutions.

In some forms, a relative volume of each of the at least two different aqueous solutions when introduced into the at least one chamber is determined by a location of a bypass capillary valve within the at least one chamber. The at least one chamber can be at least two chambers. The microfluidic device can further comprise a main channel, wherein the at least one chamber is in fluid communication with the main channel via the at least one capillary valve. The main channel can comprise an inlet, an outlet, an upstream portion, and a downstream portion. The upstream portion can be disposed between the inlet and the downstream portion, and the downstream portion can be disposed between the upstream portion and the outlet. The at least one capillary valve can include a first capillary valve, a second capillary valve, and a third capillary valve.

The microfluidic device can further comprise a first fluid path, a second fluid path, a third fluid path, and a bypass fluid path. The first fluid path can provide fluid communication between a first chamber of the at least two chambers and the upstream portion of the main channel. The first fluid path can include the first capillary valve. The first capillary valve can have a first pressure threshold. The second fluid path can provide fluid communication between the first chamber and a second chamber of the at least two chambers. The second fluid path can include the second capillary valve. The second capillary valve can have a second pressure threshold. The third fluid path can provide fluid communication between the second chamber and the downstream portion of the main channel. The third fluid path can include the third capillary valve. The third capillary valve can have a third pressure threshold. The bypass fluid path can provide fluid communication between one of the at least two chambers and the downstream portion of the main channel. The bypass fluid path can include the bypass capillary valve having a bypass pressure threshold. The bypass fluid path can provide fluid communication between the first chamber and the downstream portion. The bypass fluid path can connect to the first chamber upstream of the second fluid path. The bypass fluid path can provide fluid communication between the second chamber and the downstream portion.

The bypass fluid path can connect to the second chamber upstream of the third fluid path. The bypass fluid path can be positioned at a location wherein introducing a first aqueous solution of the at least two different aqueous solutions fills a first portion of the at least two chambers and subsequently introducing a non-aqueous fluid fills a second portion of the at least two chambers, thereby separating the first aqueous solution from the upstream portion of the main channel, and wherein introducing a second aqueous solution of the at least two different aqueous solutions fills the second portion of the at least two chambers and forces the non-aqueous fluid out of the at least two chambers through the bypass fluid path.

In some cases, the second pressure threshold can be greater than the first pressure threshold, and the third pressure threshold can be greater than the second pressure threshold, and the bypass pressure threshold can be greater than the second pressure threshold but less than the third pressure threshold.

The at least two chambers can further be at least three chambers including a first chamber, a second chamber, and a third chamber. In this case, the microfluidic device can comprise a first fluid path, a second fluid path, a third fluid path, a fourth fluid path, and a bypass fluid path. The first fluid path can provide fluid communication between the first chamber of the at least three chambers and the upstream portion of the main channel. The first fluid path can include the first capillary valve. The first capillary valve can have a first pressure threshold. The second fluid path can provide fluid communication between the first chamber and a second chamber of the at least three chambers. The second fluid path can include the second capillary valve. The second capillary valve can have a second pressure threshold. The third fluid path can provide fluid communication between the second chamber and the third chamber of the at least three chambers. The third fluid path can include the third capillary valve. The third capillary valve can have a third pressure threshold. The fourth fluid path can provide fluid communication between the third chamber and the downstream portion of the main channel. The fourth fluid path can include a fourth capillary valve. The fourth capillary valve can have a fourth pressure threshold. The bypass fluid path can provide fluid communication between one of the at least three chambers and the downstream portion of the main channel. The bypass fluid path can include the bypass capillary valve having a bypass pressure threshold.

In some cases, the second pressure threshold can be greater than the first pressure threshold, and the third pressure threshold can be greater than the second pressure threshold, and the fourth pressure threshold can be greater than the third pressure threshold, and the bypass pressure threshold can be greater than the third pressure threshold and less than the fourth pressure threshold.

The bypass fluid path can provide fluid communication between the first chamber and the downstream portion. The bypass fluid path can connect to the first chamber upstream of the second fluid path. The bypass fluid path can provide fluid communication between the second chamber and the downstream portion. The bypass fluid path can connect to the second chamber upstream of the third fluid path. The bypass fluid path can provide fluid communication between the third chamber and the downstream portion. The bypass fluid path can connect to the third chamber upstream of the fourth fluid path. The bypass fluid path can be positioned at a location wherein introducing a first aqueous solution of the at least two different aqueous solutions fills a first portion of the at least three chambers and subsequently introducing a non-aqueous fluid fills a second portion of the at least three chambers, thereby separating the first aqueous solution from the upstream portion of the main channel, and wherein introducing a second aqueous solution of the at least two different aqueous solutions fills the second portion of the at least three chambers and forces the non-aqueous fluid out of the at least three chambers through the bypass fluid path.

The first chamber can have a first volume and the second chamber can have a second volume that is larger than the first volume. The first chamber can have a first volume and the second chamber can have a second volume that is smaller than the first volume. The first chamber can have a first volume and the second chamber can have a second volume that is larger than the first volume. The first chamber can have a first volume and the second chamber can have a second volume that is smaller than the first volume. The third chamber can have a third volume that is larger than the second volume. The third chamber can have a third volume that is smaller than the second volume. The third chamber can have a third volume that is larger than the first volume. The third chamber can have a third volume that is smaller than the first volume. The at least one isolation unit can be at least four isolation units.

The disclosure additionally provides a microfluidic device comprising at least one chamber configured to receive at least two different aqueous solutions and a non-aqueous fluid, wherein the at least two different aqueous solutions and the non-aqueous fluid are selectively introduced into the at least one chamber based on pressure levels of the at least two different aqueous solutions and the non-aqueous fluid so as to prevent mixing of the at least two different aqueous solutions prior to entering the at least one chamber.

The disclosure further provides a microfluidic device comprising at least one chamber configured to receive at least two different aqueous solutions, wherein the at least two different aqueous solutions are selectively introduced into the at least one chamber based on a pressure level of the at least two different aqueous solutions.

The disclosure further still provides a microfluidic device comprising a main channel and an isolation unit. The main channel comprises an inlet, an outlet, an upstream portion, and a downstream portion. The isolation unit comprises a first chamber, a second chamber, a first fluid path, a second fluid path, a third fluid path, and a bypass fluid path. The first fluid path provides fluid communication between the upstream portion of the main channel and the first chamber and includes a first capillary valve. The second fluid path provides fluid communication between the first chamber and the second chamber and includes a second capillary valve. The third fluid path provides fluid communication between the second chamber and the downstream portion of the main channel and includes a third capillary valve. The bypass fluid path provides fluid communication between one of the first and second chambers and the downstream portion of the main channel and includes a bypass capillary valve.

The disclosure also provides a microfluidic device comprising a main channel and an isolation unit. The main channel comprises an inlet, an outlet, an upstream portion, and a downstream portion. The isolation unit comprises at least one chamber, a first fluid path, a second fluid path, and a bypass fluid path. The first fluid path provides fluid communication between the upstream portion of the main channel and the at least one chamber and includes a first capillary valve. The second fluid path provides fluid communication between the at least one chamber and the downstream portion of the main channel and includes a second capillary valve. The bypass fluid path provides fluid communication between the at least one chamber and the downstream portion of the main channel and includes a bypass capillary valve, the bypass fluid path being positioned at a location wherein introducing a first aqueous solution fills the at least one chamber a first portion of the at least one chamber and the bypass fluid path allows a non-aqueous fluid to fill a second portion of the at least one chamber, thereby separating the first aqueous solution from the upstream portion of the main channel, and wherein introducing a second aqueous solution fills the at least one chamber the second portion of the volume of the at least one chamber and forces the non-aqueous fluid out of the at least one chamber through the bypass fluid path.

The disclosure additionally provides a microfluidic device comprising at least one chamber configured to receive at least two different aqueous solutions and a non-aqueous fluid, wherein the at least two different aqueous solutions are selectively introduced into the at least one chamber based on a pressure level of the at least two different aqueous solutions with the non-aqueous fluid being introduced into the at least one chamber before and after each of the at least two different aqueous solutions at varying pressure levels so as to prevent mixing of the at least two different aqueous solutions prior to entering the at least one chamber.

The disclosure further provides a method of isolating a mixture comprising at least two different aqueous solutions. The method comprises selectively introducing the at least two different aqueous solutions and a non-aqueous fluid into at least one chamber based on pressure levels of the at least two different aqueous solutions and the non-aqueous fluid so as to prevent mixing of the at least two different aqueous solutions prior to entering the at least one chamber.

In some forms, introducing the at least two different aqueous solutions and the non-aqueous fluid into at least one chamber can include introducing the at least two different aqueous solutions and the non-aqueous fluid into a first chamber of at least two chambers. Introducing the at least two different aqueous solutions and the non-aqueous fluid into the first chamber can comprise: a) introducing a first aqueous solution of the at least two different aqueous solutions into the first chamber at a first pressure; b) subsequent to step a), introducing the non-aqueous fluid into the first chamber at a second pressure; and c) subsequent to step b), introducing a second aqueous solution of the at least two different aqueous solutions into the first chamber at a third pressure. The second pressure can be greater than the first pressure and the third pressure can be greater than the first pressure but less than the second pressure.

Introducing the first aqueous solution into the first chamber at the first pressure can allow the first aqueous solution to pass through a first fluid path having a first capillary valve with a first pressure threshold that is lower than the first pressure. Introducing the non-aqueous fluid into the first chamber at the second pressure can force the first aqueous solution through a second fluid path having a second capillary valve with a second pressure threshold lower than the second pressure, but higher than the first pressure, into a second chamber of the at least two chambers. When the non-aqueous fluid is introduced into the first chamber, it can flow into the first chamber until it reaches a bypass fluid path at which point a first portion of the first chamber can be filled with the non-aqueous fluid. The bypass fluid path can have a bypass capillary valve with an aqueous bypass pressure threshold higher than the second pressure and a non-aqueous bypass pressure threshold lower than the second pressure. Once the non-aqueous fluid has filled the first portion and reaches the bypass valve, the non-aqueous fluid can begin to flow through the bypass fluid path. Introducing the second aqueous solution into the first chamber at the third pressure can force the non-aqueous fluid out of the first chamber, through the bypass fluid path, until the second aqueous solution has replaced the non-aqueous fluid in the first portion of the first chamber.

The disclosure additionally provides a method of isolating a first aqueous solution and a second aqueous solution. The method comprises: a) introducing the first aqueous solution into an inlet of a microfluidic device at a first pressure, the first pressure greater than a first pressure threshold of a first capillary valve and less than a second pressure threshold of a second capillary valve; b) subsequent to step a), introducing a non-aqueous fluid into the inlet of the microfluidic device at a second pressure, the second pressure greater than the second pressure threshold and less than a third pressure threshold of a third capillary valve; c) subsequent to step b), introducing the second aqueous solution into the inlet of the microfluidic device at a third pressure, the third pressure greater than the first pressure threshold and less than the second pressure threshold; and d) subsequent to step c), introducing the non-aqueous fluid into the inlet of the microfluidic device at a fourth pressure, the fourth pressure greater than the first pressure threshold and less than the second pressure threshold.

The disclosure also provides a method of isolating a first aqueous solution and a second aqueous solution. The method comprises: a) introducing the first aqueous solution into the inlet of the microfluidic device described herein at a first pressure; b) subsequent to step a), introducing a non-aqueous fluid into the inlet of the microfluidic device at a second pressure, the second pressure greater than the first pressure; c) subsequent to step b), introducing the second aqueous solution into the inlet of the microfluidic device at a third pressure, the third pressure less than the second pressure; d) subsequent to step c), introducing the non-aqueous fluid into the inlet of the microfluidic device at a fourth pressure, the fourth pressure less than the second pressure.

The disclosure further provides a method of isolating a first mixture comprising a first aqueous solution and a second aqueous solution and a second mixture comprising a third aqueous solution and the second aqueous solution. The method comprises: a) introducing the first aqueous solution into the inlet of the microfluidic device described herein at a first pressure; b) subsequent to step a), introducing a non-aqueous fluid into the inlet of the microfluidic device at a second pressure, the second pressure greater than the first pressure; c) subsequent to step b), introducing the third aqueous solution into the inlet of the microfluidic device at a third pressure, the third pressure less than the second pressure; d) subsequent to step c), introducing the non-aqueous fluid into the inlet of the microfluidic device at a fourth pressure, the fourth pressure greater than the second pressure; e) subsequent to step d), introducing the second aqueous solution into the inlet of the microfluidic device at a fifth pressure, the fifth pressure greater than the second pressure.

The disclosure additionally provides a method of isolating a mixture comprising at least two different aqueous solutions. The method comprises: a) introducing a first of the at least two different aqueous solutions into at least one chamber at a first pressure; b) subsequent to step a), introducing a non-aqueous fluid into the at least one chamber at a second pressure higher than the first pressure; c) subsequent to step b), introducing a second of the at least two different aqueous solutions into the at least one chamber at a third pressure.

The disclosure also provides a method of isolating a mixture comprising at least two different aqueous solutions. The method comprises: a) introducing a first of the at least two different aqueous solutions into at least one chamber; b) subsequent to step a), introducing a non-aqueous fluid into the at least one chamber; c) subsequent to step b), introducing a second of the at least two different aqueous solutions into the at least one chamber.

The disclosure further provides a method of isolating a mixture. The method comprises selectively introducing at least two different aqueous solutions into at least one chamber based on a pressure level of the at least two different aqueous solutions.

Thus, the disclosure provides a method for simultaneous generation and storage of isolated droplets of aqueous mixtures on a micro-scale, thus allowing for a multitude of concentrations to be tested for crystallization of proteins, while minimizing waste.

Although the invention has been described in considerable detail with reference to certain embodiments, one skilled in the art will appreciate that the present invention can be practiced by other than the described embodiments, which have been presented for purposes of illustration and not of limitation. Therefore, the scope of the appended claims should not be limited to the description of the embodiments contained herein.

What is claimed is:

1. A method of isolating a mixture comprising at least two different aqueous solutions, the method comprising:

selectively introducing the at least two different aqueous solutions, including first and second aqueous solutions, and a separate non-aqueous fluid into at least one chamber based on pressure levels of the at least two different aqueous solutions and the non-aqueous fluid, such that the separate non-aqueous fluid isolates the first aqueous solution from the second aqueous solution prior to the second aqueous solution entering the at least one chamber.

2. A microfluidic device comprising:

at least one isolation unit having at least one chamber;

the at least one chamber configured to receive and hold at least two different aqueous solutions; and at least one capillary valve configured to allow for the at least two different aqueous solutions to be introduced into the at least one chamber without mixing prior to entering the at least one chamber based at least in part on pressure levels of the at least two different aqueous solutions, such that the at least two different aqueous solutions are isolated from one another prior to entering the at least one chamber.

3. The microfluidic device of claim 2, wherein a relative volume of each of the at least two different aqueous solutions when introduced into the at least one chamber is determined by a location of a bypass capillary valve within the at least one chamber.

4. The microfluidic device of claim 2, further comprising a main channel, wherein the at least one chamber is in fluid communication with the main channel via the at least one capillary valve, the main channel comprising an inlet, an outlet, an upstream portion, and a downstream portion.

5. The microfluidic device of claim 4, wherein the upstream portion is disposed between the inlet and the downstream portion, and the downstream portion is disposed between the upstream portion and the outlet.

6. The microfluidic device of claim 4, wherein the at least one chamber is at least two chambers, and wherein the at least one capillary valve includes a first capillary valve, a second capillary valve, and a third capillary valve.

7. The microfluidic device of claim 6, further comprising:

a first fluid path providing fluid communication between a first chamber of the at least two chambers and the upstream portion of the main channel, the first fluid path including the first capillary valve, the first capillary valve having a first pressure threshold;

a second fluid path providing fluid communication between the first chamber and a second chamber of the at least two chambers, the second fluid path including the second capillary valve, the second capillary valve having a second pressure threshold;

a third fluid path providing fluid communication between the second chamber and the downstream portion of the main channel, the third fluid path including the third capillary valve, the third capillary valve having a third pressure threshold; and a bypass fluid path providing fluid communication between one of the at least two chambers and the downstream portion of the main channel, the bypass fluid path including a bypass capillary valve having a bypass pressure threshold.

8. The microfluidic device of claim 7, wherein the bypass fluid path provides fluid communication between the first chamber and the downstream portion, the bypass fluid path connecting to the first chamber upstream of the second fluid path.

9. The microfluidic device of claim 7, wherein the bypass fluid path provides fluid communication between the second chamber and the downstream portion, the bypass fluid path connecting to the second chamber upstream of the third fluid path.

10. The microfluidic device of claim 8, wherein the bypass fluid path is positioned at a location wherein introducing a first aqueous solution of the at least two different aqueous solutions fills a first portion of the at least two chambers and subsequently introducing a non-aqueous fluid fills a second portion of the at least two chambers, thereby separating the first aqueous solution from the upstream portion of the main channel, and wherein introducing a second aqueous solution of the at least two different aqueous solutions fills the second portion of the at least two chambers and forces the non-aqueous fluid out of the at least two chambers through the bypass fluid path.

11. The microfluidic device of claim 6, wherein the at least two chambers is at least three chambers including a first chamber, a second chamber, and a third chamber.

12. The microfluidic device of claim 11, further comprising:

a first fluid path providing fluid communication between the first chamber of the at least three chambers and the upstream portion of the main channel, the first fluid path including the first capillary valve, the first capillary valve having a first pressure threshold;

a second fluid path providing fluid communication between the first chamber and a second chamber of the at least three chambers, the second fluid path including the second capillary valve, the second capillary valve having a second pressure threshold;

a third fluid path providing fluid communication between the second chamber and the third chamber of the at least three chambers, the third fluid path including the third capillary valve, the third capillary valve having a third pressure threshold;

a fourth fluid path providing fluid communication between the third chamber and the downstream portion of the main channel, the fourth fluid path including a fourth capillary valve, the fourth capillary valve having a fourth pressure threshold; and a bypass fluid path providing fluid communication between one of the at least three chambers and the downstream portion of the main channel, the bypass fluid path including a bypass capillary valve having a bypass pressure threshold.

13. The microfluidic device of claim 7, wherein the second pressure threshold is greater than the first pressure threshold, the third pressure threshold is greater than the second pressure threshold, and the bypass pressure threshold is greater than the second pressure threshold but less than the third pressure threshold.

14. The microfluidic device of claim 12, wherein the second pressure threshold is greater than the first pressure threshold, the third pressure threshold is greater than the second pressure threshold, the fourth pressure threshold is greater than the third pressure threshold, and the bypass pressure threshold is greater than the third pressure threshold and less than the fourth pressure threshold.

15. The microfluidic device of claim 12, wherein the bypass fluid path provides fluid communication between:

i) the first chamber and the downstream portion, the bypass fluid path connecting to the first chamber upstream of the second fluid path;

ii) wherein the bypass fluid path provides fluid communication between the second chamber and the downstream portion, the bypass fluid path connecting to the second chamber upstream of the third fluid path; or iii) wherein the bypass fluid path provides fluid communication between the third chamber and the downstream portion, the bypass fluid path connecting to the third chamber upstream of the fourth fluid path.

16. The microfluidic device of claim 15, wherein the bypass fluid path is positioned at a location wherein introducing a first aqueous solution of the at least two different aqueous solutions fills a first portion of the at least three chambers and subsequently introducing a non-aqueous fluid fills a second portion of the at least three chambers, thereby separating the first aqueous solution from the upstream portion of the main channel, and wherein introducing a second aqueous solution of the at least two different aqueous solutions fills the second portion of the at least three chambers and forces the non-aqueous fluid out of the at least three chambers through the bypass fluid path.

17. The microfluidic device of claim 7, wherein the first chamber has a first volume and the second chamber has a second volume wherein:

the first volume is greater than the second volume; or the second volume is greater than the first volume.

18. The microfluidic device of claim 11, wherein the first chamber has a first volume, the second chamber has a second volume, and the third chamber has a third volume, wherein:

the first volume is greater than the second volume, and the first volume is greater than the third volume; or the second volume is greater than the first volume, and the second volume is greater than the third volume; or the third volume is greater than the first volume, and the third volume is greater than the second volume.

19. A microfluidic device comprising:

at least one chamber configured to receive at least two different aqueous solutions and a non-aqueous fluid, wherein the at least two different aqueous solutions and the non-aqueous fluid are selectively introduced into and retained in the at least one chamber based on pressure levels of the at least two different aqueous solutions and the non-aqueous fluid so as to isolate the at least two different aqueous solutions from one another prior to entering the at least one chamber.

* * * * *